US012440033B2

(12) United States Patent
Davis, IV

(10) Patent No.: US 12,440,033 B2
(45) Date of Patent: Oct. 14, 2025

(54) CUSTOMIZABLE FURNITURE SYSTEM

(71) Applicant: George Dollie Davis, IV, Lawrenceville, GA (US)

(72) Inventor: George Dollie Davis, IV, Lawrenceville, GA (US)

( * ) Notice: Subject to any disclaimer, the term of this patent is extended or adjusted under 35 U.S.C. 154(b) by 164 days.

(21) Appl. No.: 18/507,184

(22) Filed: Nov. 13, 2023

(65) Prior Publication Data

US 2024/0335047 A1 Oct. 10, 2024

Related U.S. Application Data

(60) Provisional application No. 63/494,046, filed on Apr. 4, 2023.

(51) Int. Cl.

| | |
|---|---|
| ***A47C 4/02*** | (2006.01) |
| ***A47C 5/12*** | (2006.01) |
| ***A47C 13/00*** | (2006.01) |
| ***A47C 15/00*** | (2006.01) |
| ***A47C 31/00*** | (2006.01) |
| ***B63C 9/00*** | (2006.01) |
| *B63C 9/30* | (2006.01) |

(52) U.S. Cl.

CPC ..... *A47C 15/006* (2013.01); *A47C 5/12* (2013.01); *A47C 13/005* (2013.01); *A47C 4/02* (2013.01); *A47C 31/003* (2013.01); *B63C 9/30* (2013.01)

(58) Field of Classification Search

CPC ..... A47C 4/02; A47C 13/005; A47C 15/006; A47C 31/003; B63C 9/30

See application file for complete search history.

(56) References Cited

U.S. PATENT DOCUMENTS

| | | | | |
|---|---|---|---|---|
| 3,973,800 A | | 8/1976 | Kogan | |
| 3,984,888 A | * | 10/1976 | DeLano | B63C 9/28 441/132 X |
| 4,115,888 A | * | 9/1978 | Sievers | B63B 34/50 441/132 |
| 4,662,852 A | * | 5/1987 | Schneider | A47C 15/006 441/132 X |
| 4,675,929 A | * | 6/1987 | Santo | A47C 19/025 5/915 |

(Continued)

FOREIGN PATENT DOCUMENTS

| | | | | |
|---|---|---|---|---|
| GB | 545927 A | * | 6/1942 | A47C 4/54 |
| GB | 2473819 A | * | 3/2011 | A47C 15/006 |

*Primary Examiner* — Rodney B White

(74) *Attorney, Agent, or Firm* — Brennan, Manna & Diamond, LLC

(57) ABSTRACT

A customizable furniture frame made from recycled materials, available in various shapes and sizes, and designed to function both as modular furniture and a flotation device in emergency situations, such as floods or in a pool or lake situation. A plurality of Snap-on connectors is disposed on the exterior surface of the frame facilitating the selective attachment and detachment of furniture panels/pieces made from materials such as wood, foam, plastic, metal, or fabric. The panels have Snap-on sockets aligned with the connectors for removably attaching the panels/pieces to the frame to form customized furniture layouts. The frame is hollow and provides buoyancy for floating of the frame with one or more users sitting on the frame. The frame and panels form a customizable furniture system that can evolve with changing tastes and preferences.

11 Claims, 5 Drawing Sheets

(56) References Cited

U.S. PATENT DOCUMENTS 4,986,781 A * 1/1991 Smith ..... A47C 15/006 441/130
5,004,296 A 4/1991 Ziegenfuss, Jr.
5,224,891 A * 7/1993 Stephens ..... A47C 15/006 441/130
5,403,220 A * 4/1995 Goad, Sr. ..... B63B 34/10 441/130
5,439,405 A * 8/1995 Storey ..... B63B 34/50 441/127
5,560,056 A * 10/1996 Tai ..... A45F 3/22 297/452.41 X
5,890,767 A 4/1999 Chang
6,042,186 A * 3/2000 Kojic ..... A47C 4/54 297/452.41 X
6,045,423 A * 4/2000 Silvia ..... B63B 34/50 441/130
6,059,360 A * 5/2000 Bedard ..... B60N 2/2821 441/130
6,086,150 A * 7/2000 Scheurer ..... A47C 15/006 441/130
6,224,444 B1 * 5/2001 Klimenko ..... A47C 15/006 441/130
6,312,054 B1 * 11/2001 Scheurer ..... A47C 15/006 441/130
6,691,356 B1 * 2/2004 Coma ..... A47G 9/062 5/722
6,746,293 B1 * 6/2004 Kirby, Jr. ..... A47C 15/006 441/132 X
7,213,885 B2 5/2007 White, III
7,963,612 B2 6/2011 Nelson
9,139,263 B2 * 9/2015 Rubey ..... G01N 33/56911
9,144,318 B1 * 9/2015 Lagier ..... A47C 3/16
9,408,474 B2 * 8/2016 Rubey ..... A47C 4/02
9,642,467 B2 * 5/2017 Rubey ..... A47C 1/143
10,194,224 B2 * 1/2019 Azar Cohen ..... A47C 15/006
10,383,450 B2 * 8/2019 Iles ..... A47C 1/143
10,743,672 B2 * 8/2020 Iles ..... A47C 7/5066
10,758,049 B2 * 9/2020 Cooper ..... A47C 27/081
11,412,858 B2 * 8/2022 Iles ..... A47C 15/006
2005/0099054 A1 * 5/2005 McCarthy ..... A47C 17/045 297/452.41
2016/0096598 A1 * 4/2016 Harkrider ..... B63B 34/52 441/130
2023/0172329 A1 * 6/2023 Dogagis ..... A45C 9/00 190/1
2023/0201732 A1 * 6/2023 Waters ..... A47C 15/006 441/35

* cited by examiner

CUSTOMIZABLE FURNITURE SYSTEM

CROSS-REFERENCE TO RELATED APPLICATION

The present application claims priority to, and the benefit of, U.S. Provisional Application No. 63/494,046, which was filed on Apr. 4, 2023, and is incorporated herein by reference in its entirety.

FIELD OF THE INVENTION

The present invention generally relates to the field of furniture systems. More specifically, the present invention relates to a novel customizable furniture frame used for forming customized furniture pieces using furniture panels/pieces. The frame includes a hollow body constructed from recycled material, the frame including a plurality of Snap-on connectors disposed on the exterior surface of the frame for the attachment and detachment of furniture panels/pieces, enabling the creation of a customized furniture piece wherein the furniture panels/pieces include a plurality of Snap-on sockets, the Snap-on connectors, and the Snap-on sockets are aligned to selectively remove and fasten the frame and the furniture panels/pieces. The frame can be used as a floating device in floods for protection from drowning. Accordingly, the present disclosure makes specific reference thereto. Nonetheless, it is to be appreciated that aspects of the present invention are also equally applicable to other like applications, devices, and methods of manufacture.

BACKGROUND

By way of background, individuals use furniture in homes and businesses both for practical purposes and for enhancing the overall aesthetic appeal of the space. Furniture serves both functional and decorative roles. However, traditional furniture typically comes in fixed designs and finishes and cannot be customized to meet surrounding aesthetics and space constraints. This lack of customization in conventional furniture can be limiting as individuals cannot match the furniture with their unique preferences, space constraints, color schemes, or evolving interior decor. Over time, individuals may get bored with the appearance of their furniture. Also, when renovating or redecorating a space, individuals may find a need to replace furniture pieces, which can be expensive. Replacing furniture can be a costly endeavor, especially when the furniture pieces cannot be modified or repurposed in any way. The cost of buying new furniture can deter individuals from making frequent changes to their interior decor. Furthermore, the inability to customize furniture can be frustrating for individuals who are passionate about creating the perfect home or workspace.

Traditional furniture pieces are also often heavy and bulky, making it difficult to transport the furniture pieces between locations. In the event of natural disasters, furniture pieces can be severely damaged or destroyed. Replacing such furniture can be expensive and time-consuming. As a result, there is a need among individuals for furniture that is both reusable and customizable.

Therefore, there exists a long-felt need in the art for customizable and reusable furniture. Additionally, there is a long-felt need in the art for improved furniture that allows users to easily attach and detach interchangeable parts on the furniture frame to customize the furniture's appearance and overall dimensions. Moreover, there is a long-felt need in the art for reusable furniture that is lightweight and made of recyclable materials. Further, there is a long-felt need in the art for furniture pieces that are easy to transport and are safe from natural disasters. Furthermore, there is a long-felt need in the art for customizable furniture that allows users to swap out interchangeable parts or pieces to renew the look of their furniture and to fit the furniture into customizable spaces. Finally, there is a long-felt need in the art for customizable and adaptable furniture that can be updated without the need for expensive replacements and is easier to clean promoting reusability.

The subject matter disclosed and claimed herein, in one embodiment thereof, comprises a customizable furniture frame. The frame is used for forming customized furniture pieces and comprises a hollow body constructed from recycled material, the frame includes a plurality of Snap-on connectors disposed on the exterior surface of the frame for the attachment and detachment of furniture panels/pieces and furniture pieces, enabling the creation of a customized furniture piece wherein the furniture panels/pieces/pieces include a plurality of Snap-on sockets, the Snap-on connectors and the Snap-on sockets are aligned to selectively remove and fasten the frame and the furniture panels/pieces to make customized furniture pieces. The frame is hollow and includes an internal housing for storing a plurality of items. The frame can be used as a floating device to float on water for protection from drowning for users by sitting on the frame.

In this manner, the customizable furniture frame and the customized furniture piece of the present invention accomplish all of the foregoing objectives and provide users with a hollow frame having multiple Snap-on connectors that enable users to removably connect furniture panels/pieces to make a customized furniture piece. The hollow interior structure of the frame allows the frame to serve as a flotation device in case of a flood or other natural disasters. The frame allows users to easily modify the external appearance with Snap-on connectors and panels to save time, preventing buying of new furniture and enabling customization.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a customizable furniture frame. The frame is used for forming customized furniture pieces and comprising a hollow body constructed from recycled material, the frame including a plurality of Snap-on connectors disposed on the exterior surface of the frame for the attachment and detachment of furniture panels/pieces, enabling the creation of a customized furniture piece wherein the furniture panels/pieces include a plurality of Snap-on sockets, the Snap-on connectors and the Snap-on sockets are aligned to selectively remove and fasten the frame and the furniture panels/pieces.

In yet another embodiment, a customizable furniture frame for forming a customized furniture piece is disclosed. The frame includes a hollow body constructed from recycled material, the frame is configured in a conventional living room furniture piece shape, including a backrest, a seating surface, and a pair of armrest elements, a plurality of legs for providing stable support for placement on a surface. The hollow design of the frame provides a buoyant force to allow the frame to function as a flotation device capable of floating in water and serving as emergency furniture during natural disasters such as floods. The exterior surface of the frame features a plurality of Snap-On connectors thereon for the attachment and detachment of multiple furniture panels/pieces, enabling the creation of a customized furniture piece. An interior storage area is included within the frame for storing various items, including personal belongings, emergency equipment, and first-aid supplies.

In a further embodiment, a customizable furniture system is disclosed. The system includes a frame designed as a functional furniture piece and a flotation device, the frame features a plurality of interspersed Snap-On connectors on the exterior surface thereof and a plurality of furniture panels/pieces, each panel is designed to overlap and securely adhere adjacently to specific portions of the frame, each panel or piece is integrated with a plurality of Snap-on sockets aligning with the Snap-On connectors on the frame, enabling detachable fastening of the panels to the frame and/or fastening pieces to adjacent pieces to achieve complete overlap of the designated frame portions to form a customizable furniture piece.

In a further embodiment, the panels are fabricated from diverse materials, including, but not limited to, wood, foam, plastic, metal, or fabric, and offered in various sizes, colors, and shapes to provide customization options for users.

In a further embodiment, a floating furniture frame is disclosed. The frame provides buoyant properties, facilitating the flotation of the frame on water with one or more users positioned on the frame. The floating frame is constructed as a one-piece unit or alternatively can use gaskets, seals, or specialized coatings to establish and maintain a watertight structure for the frame. The frame has a plurality of fasteners in the form of Snap-on connectors, magnets, or hook fasteners to detachably attach to a plurality of furniture panels/pieces to form a customized furniture piece.

Numerous benefits and advantages of this invention will become apparent to those skilled in the art to which it pertains upon reading and understanding of the following detailed specifications.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
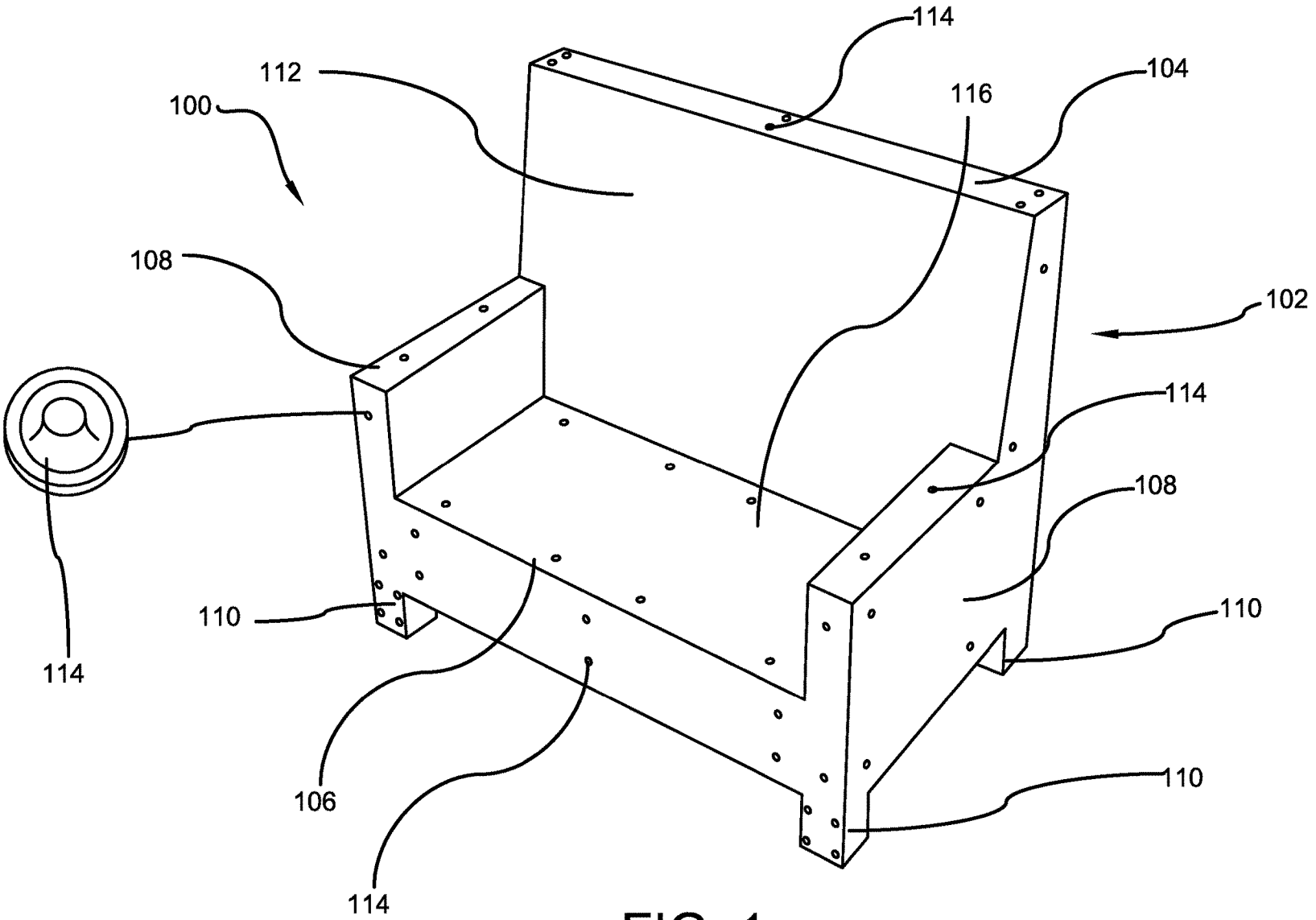
FIG. 1 illustrates a perspective view of one potential embodiment of the customizable furniture frame of the present invention in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for customizable and reusable furniture. Additionally, there is a long-felt need in the art for improved furniture that allows users to easily attach and detach interchangeable parts and pieces on the furniture frame to customize the furniture's appearance. Moreover, there is a long-felt need in the art for reusable furniture that is lightweight and made of recyclable materials. Further, there is a long-felt need in the art for furniture pieces that are easy to transport and are safe from natural disasters. Furthermore, there is a long-felt need in the art for customizable and modular furniture that allows users to swap out interchangeable parts to renew, add on, or resize the look of their furniture. Finally, there is a long-felt need in the art for customizable, modular, and adaptable furniture that can be updated without the need for expensive replacements and is easier to clean promoting reusability.

The present invention, in one exemplary embodiment, is a floating furniture frame. The frame provides buoyant properties, facilitating the flotation of the frame on water with one or more users positioned on the frame. The floating frame is constructed as a one-piece unit or alternatively can use gaskets, seals, or specialized coatings to establish and maintain a watertight structure for the frame. The frame has a plurality of fasteners in the form of Snap-on connectors, magnets, or hook fasteners to detachably attach to a plurality of furniture panels/pieces to form a customized furniture piece.

Referring initially to the drawings, FIG. 1 illustrates a perspective view of one potential embodiment of the customizable furniture frame of the present invention in accordance with the disclosed structure. The customizable furniture frame 100 of the present invention includes a hollow body 102 made of recycled material and comes in different shapes and sizes to function as a furniture piece. In the present embodiment, the frame 100 is in the shape of a conventional living room furniture piece and includes a backrest 104, a seating surface 106, and a pair of armrest elements 108. A plurality of legs 110 provides a stable support for the frame 100 to be placed on a surface. The hollow frame 100 is designed to function as a flotation device which can float in water and be used in natural calamities like floods. The frame 100 is non-porous, resistant to stains, and impervious to liquids and can be cleaned easily by wiping with a cloth or even with water. The frame 100 can be made of a material such as recycled plastic composite, natural wood, aluminum, or hybrid materials. The frame 100 can be combined with other frames 100 to form modular furniture to meet specific size constraints and preferences.

The exterior surface 112 of the body 102 has a plurality of Snap-On connectors 114 disposed thereon. The Snap-on connectors 114 are evenly interspersed along the exterior surface 112 for enabling attachment and detachment of a plurality of panels/pieces for providing a customized furniture piece as illustrated in FIG. 2. The Snap-on connectors 114 can be made of materials such as wood, aluminum, acrylic, and plastic. Further, the Snap-on connectors 114 can be embedded into the frame 100.

The frame 100 has an interior storage area 116 used for stowing different items such as personal items, emergency equipment, first-aid supplies, and more. The interior storage area 114 can be accessed by removing the seating area 106 in the present embodiment but can be accessed by removing any portion of the frame 100 as well in different embodiments of the present invention.

Figure 2A:
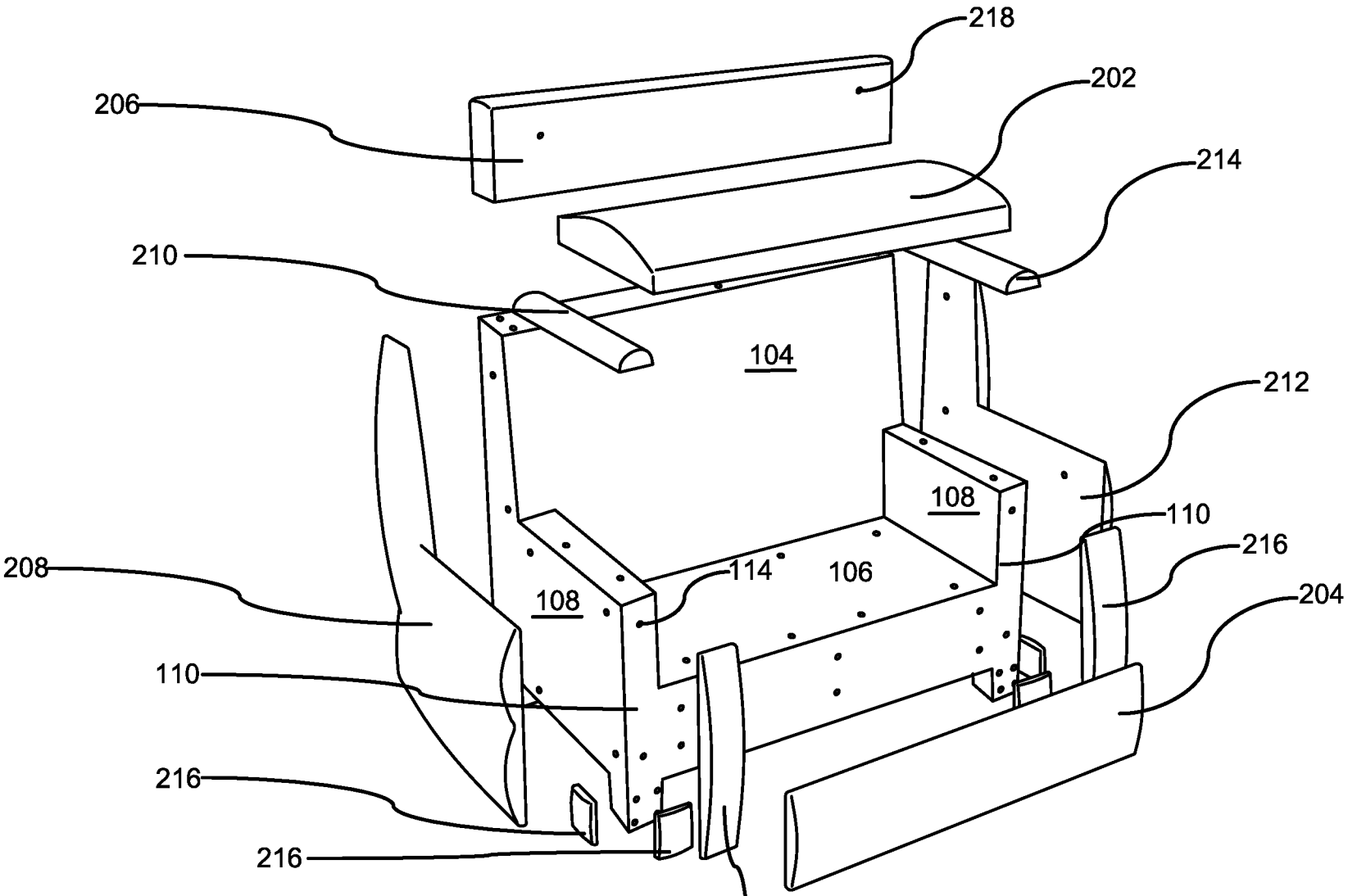
FIG. 2A illustrates a plurality of different detachable furniture panels/pieces for forming a customized furniture piece using the customizable furniture frame in accordance with the disclosed structure.

FIG. 2A illustrates a plurality of different detachable furniture panels/pieces for forming a customized and modular furniture piece using the customizable furniture frame in accordance with the disclosed structure. A plurality of panels/pieces designed to overlap and to secure to different portions of the frame 100 are used for creating a customized, modular, and reusable furniture piece. As illustrated, seating surface overlapping panels 202, 204, a backrest overlapping panel 206, a first armrest covering panels 208, 210, a second armrest covering panels 212, 214, and legs covering panels 216 are provided. The panels 202, 204 adhere to and overlap the seating surface 106, the backrest overlapping panel 206 adheres to and overlaps the backrest 104, the first armrest covering panels 208, 210 and the second armrest covering panels 212, 214 cover the armrests 108 and the legs covering panels 216 adhere to the legs 110 of the frame 100 of FIG. 1.

Each panel adhered to the frame 100 includes a plurality of Snap-on sockets 218 disposed in alignment with the Snap-on connectors 114 disposed on the frame 100. The Snap-on connectors 114 and the Snap-on sockets 218 are detachably fastened together to allow each panel to completely overlap the intended portion of the frame 100. The furniture panels/pieces can be made from various materials, such as wood, foam, plastic, metal, or fabric, and can come in different sizes, colors, and shapes. Each panel or piece is designed to fit the curves, angles, and dimensions of the frame to provide a precise and snug fit on the frame.

Figure 2B:
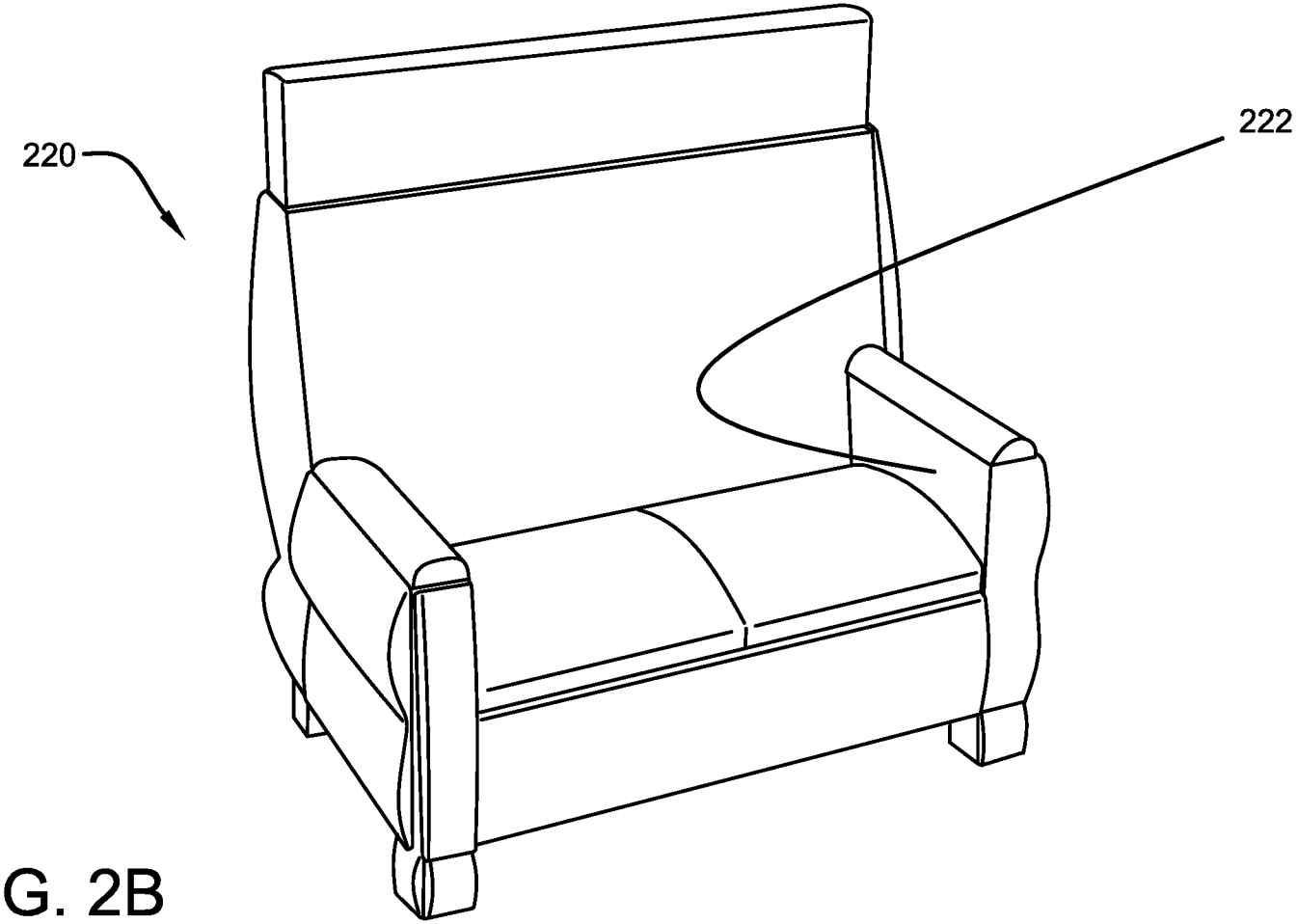
FIG. 2B illustrates a perspective view of a customized furniture piece formed by fastening the panels to the frame as illustrated in FIG. 2A in accordance with the disclosed structure.

FIG. 2B illustrates a perspective view of a customized furniture piece formed by fastening the panels to the frame as illustrated in FIG. 2A in accordance with the disclosed structure. As illustrated, the furniture panels/pieces overlap the designated frame portion for providing a customized furniture piece 220. The customized furniture piece 220 can have one or more portions 222 of the frame 100 exposed (not overlapped by the panels) as per design requirements of the users. Further, the panels can be easily detached from the frame 100 for cleaning, replacing, and to further customize the furniture piece 220.

In some embodiments of the present invention, opposite polarity magnets can be disposed on the frame 100 and the panels for enabling a magnetic fastening between the frame 100 and the panels to form the customized furniture piece. In other embodiments, hook and loop fasteners can be used on the frame 100 and panels respectively to form the customized furniture piece.

Figure 3:
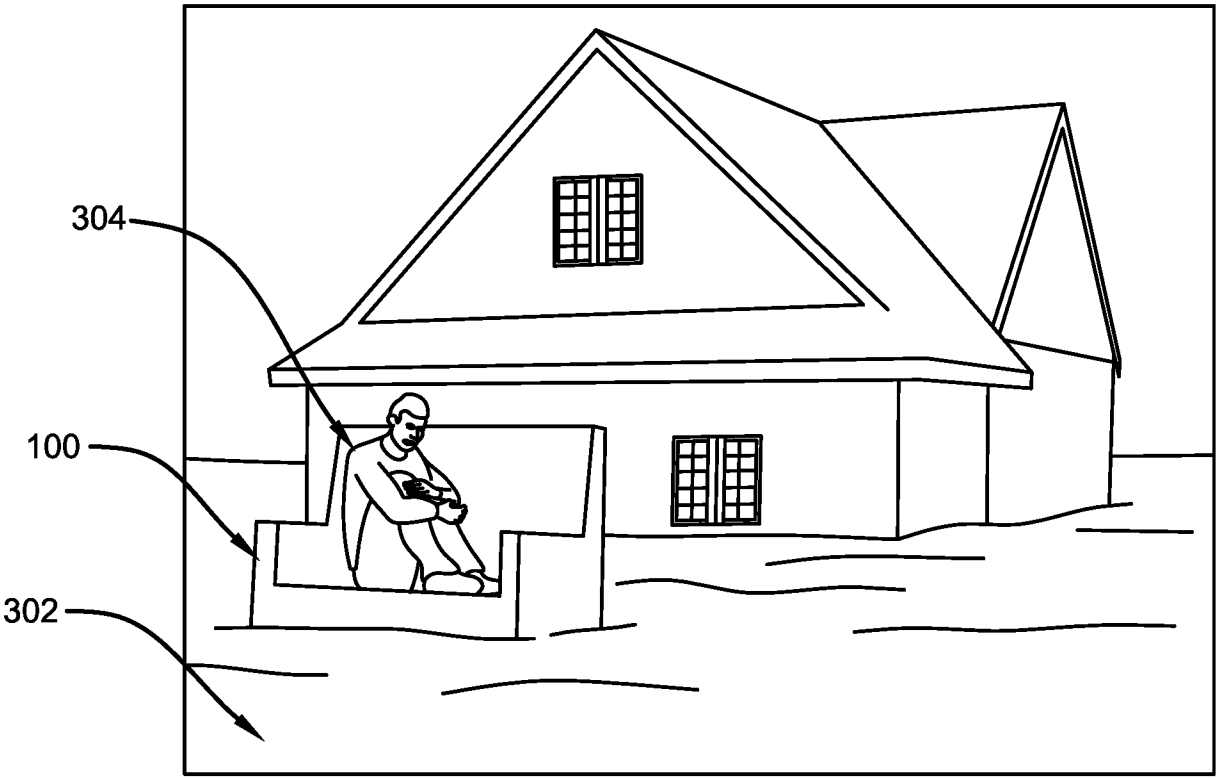
FIG. 3 illustrates a perspective view showing the use of the hollow frame of the present invention as a floating device in accordance with the disclosed structure.

FIG. 3 illustrates a perspective view showing the use of the hollow frame 100 of the present invention as a floating device in accordance with the disclosed structure. The frame 100 is designed to float on water 302 with user(s) 304 of up to a maximum weight sitting on the frame 100 in any orientation. In one embodiment, the maximum weight is 150 kg and in other embodiments, the maximum weight is 250 kg, thereby used as a floating device for multiple users. The frame 100 can provide additional protection in emergency situations such as in floods for protecting users from drowning. It is to be appreciated that the frame 100 provides a waterproof base and multiple frames can be modularly fastened together to provide a multiple-person seating arrangement. The waterproofness of the frame provides for effective seating for outdoor settings, such as porches patios, and decks. The floatation feature of the frame 100 provides additional utility and enhances the function of the furniture in which the furniture can move from a boat, a dock, a beach, and/or a poolside area to the water for lounging/recreation or as a safety device.

In some embodiments, the floating frame 100 has one-piece construction and in other embodiments, the frame 100 has watertight seals or compartments to prevent water from entering the interior housing 116. Different devices such as gaskets, seals, or coatings can be used for providing a watertight structure to the frame 100.

Figure 4:
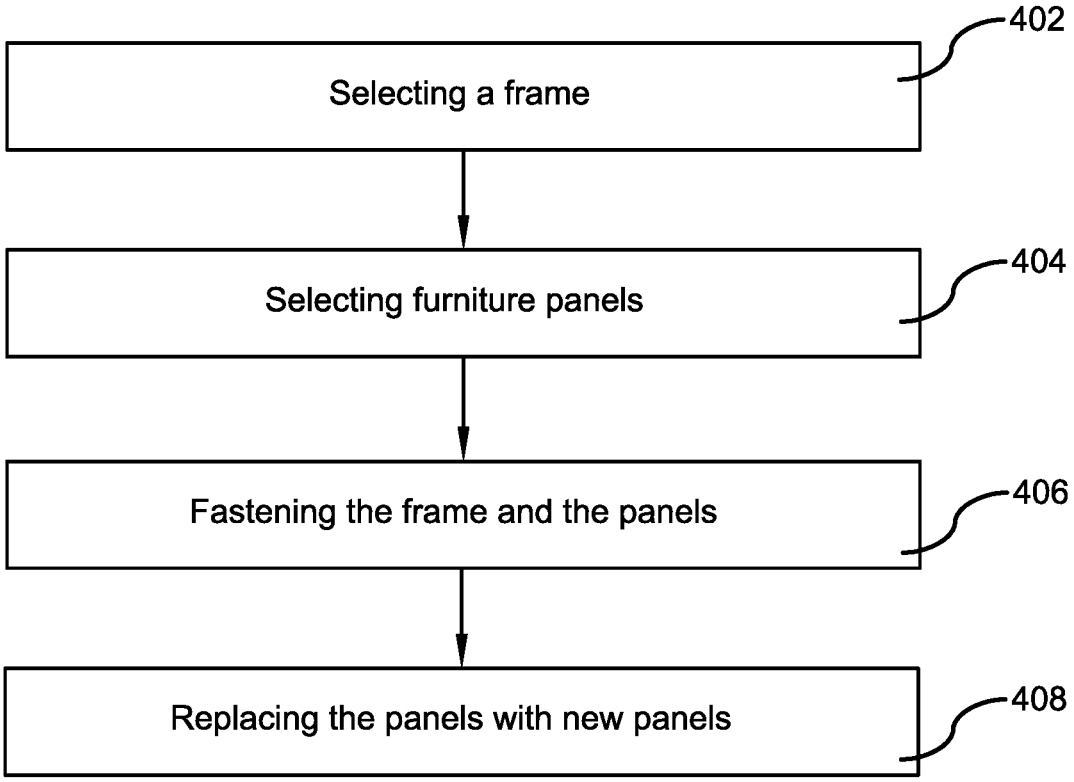
FIG. 4 illustrates a flow chart depicting the process of customizing the furniture piece of the present invention in accordance with the disclosed architecture.

FIG. 4 illustrates a flow chart depicting the process of customizing the furniture piece of the present invention in accordance with the disclosed architecture. Initially, a first frame of a specific shape and size is chosen by a user wherein the first frame can be used to make any furniture piece used in homes and businesses (Step 402). Then, a plurality of furniture panels/pieces of one or more colors are chosen to be adhered to the first frame (Step 404). Panels or pieces of different colors and materials can be available along with the first frame for customizing the modular furniture piece repeatedly by users. Thereafter, the furniture panels/pieces are removably fastened to the first frame using fasteners such as Snap-on connectors, magnets, hook, and loop fasteners, and more (Step 406). Finally, for customizing the furniture again, the adhered panels/pieces are removed and replaced with other panels/pieces of other colors/patterns/materials (Step 408).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "customizable furniture frame", "hollow frame", "floating frame", and "frame" are interchangeable and refer to the customizable furniture frame 100 of the present invention. Similarly, as used herein "customized furniture piece", "furniture piece", and "furniture" are interchangeable and refer to the customized furniture piece 220 of the present invention.

Notwithstanding the foregoing, the customizable furniture frame 100 and the customized furniture piece 220 of the present invention can be of any suitable size and configuration as is known in the art without affecting the overall concept of the invention, provided that they accomplish the above-stated objectives. One of ordinary skill in the art will appreciate that the customizable furniture frame 100 and the customized furniture piece 220 as shown in the FIGS. 1-3 are for illustrative purposes only, and that many other sizes and shapes of the customizable furniture frame 100 and the customized furniture piece 220 are well within the scope of the present disclosure. Although the dimensions of the customizable furniture frame 100 and the customized furniture piece 220 are important design parameters for user convenience, the customizable furniture frame 100 and the customized furniture piece 220 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A modular furniture frame comprising:

a furniture frame having a hollow body including a backrest, a seating surface, and a pair of armrest elements;

wherein said hollow body comprises a flotation device floatable in water;

wherein said furniture frame comprises a non-porous material impervious to liquids;

wherein said non-porous material is a plastic composite;

wherein said hollow body has an exterior surface including a plurality of snap connectors disposed thereon;

wherein said snap connectors include material selected from the group consisting of an aluminum, an acrylic and a plastic;

wherein said snap connectors are embedded into said furniture frame;

wherein said hollow body has an interior storage area;

wherein said interior storage area is accessible through a removable seating area; and further wherein said snap connectors are interspersed along said exterior surface for enabling selective attachment and detachment of another said furniture frame.

2. The modular furniture frame of claim 1, wherein said snap connectors are magnets.

3. A modular furniture frame comprising:

a furniture frame having a hollow body including a backrest, a seating surface, a plurality of legs, and a pair of armrest elements;

wherein said hollow body comprises a flotation device floatable in water;

wherein said furniture frame comprises a non-porous material impervious to liquids;

wherein said non-porous material is a plastic composite;

wherein said hollow body has an exterior surface including a plurality of magnetic snap connectors disposed thereon;

wherein said magnetic snap connectors are embedded into said furniture frame; and further wherein said magnetic snap connectors are interspersed along said exterior surface for enabling selective attachment and detachment of another said furniture frame.

4. The modular furniture frame of claim 3, wherein said hollow body has an interior storage area.

5. The modular furniture frame of claim 4, wherein said interior storage area is accessible through a removable seating area.

6. A modular furniture frame comprising:

a furniture frame having a hollow body including a backrest, a seating surface, and a pair of armrest elements;

wherein said hollow body comprises a flotation device floatable in water;

wherein said furniture frame comprises a non-porous material impervious to liquids;

wherein said non-porous material is a plastic composite;

wherein said hollow body has an exterior surface including a plurality of snap connectors disposed thereon;

wherein said snap connectors are interspersed along said exterior surface for enabling selective attachment of a plurality of panels; and further wherein said plurality of panels overlap and secure to selected areas of said exterior surface.

7. The modular furniture frame of claim 6, wherein said plurality of panels have a backrest overlapping panel, a seating surface overlapping panel, a first armrest covering panel, and a second armrest covering panel.

8. The modular furniture frame of claim 7, wherein said furniture frame is connected to at least another furniture frame for providing a customized furniture piece.

9. The modular furniture frame of claim 8, wherein said snap connectors are embedded into said furniture frame.

10. The modular furniture frame of claim 9, wherein said hollow body has an interior storage area.

11. The modular furniture frame of claim 10, wherein said hollow body has a floating capacity from 150 kg to 250 kg.

* * * * *